US008235653B2

(12) United States Patent
Genster

(10) Patent No.: US 8,235,653 B2
(45) Date of Patent: Aug. 7, 2012

(54) VARIABLE COOLANT PUMP FOR THE COOLING CIRCUIT OF AN INTERNAL COMBUSTION ENGINE

(75) Inventor: Albert Genster, Marl (DE)

(73) Assignee: Pierburg GmbH, Neuss (DE)

( * ) Notice: Subject to any disclaimer, the term of this patent is extended or adjusted under 35 U.S.C. 154(b) by 547 days.

(21) Appl. No.: 12/478,907

(22) Filed: Jun. 5, 2009

(65) Prior Publication Data

US 2009/0301412 A1 Dec. 10, 2009

(30) Foreign Application Priority Data

Jun. 6, 2008 (DE) ..... 10 2008 027 157

(51) Int. Cl.
*F01D 17/16* (2006.01)

(52) U.S. Cl. ..... 415/148

(58) Field of Classification Search ..... 123/41.44; 415/148, 151, 160, 163, 164, 165, 166; 417/436
See application file for complete search history.

(56) References Cited

U.S. PATENT DOCUMENTS 4,679,984 A * 7/1987 Swihart et al. ..... 415/163

FOREIGN PATENT DOCUMENTS

| | | |
|---|---|---|
| DE | 736266 | 6/1943 |
| DE | 964 551 B | 5/1957 |
| DE | 102004054637 | 5/2006 |
| DE | 102005004315 | 8/2006 |
| GB | 731822 | 6/1955 |
| WO | WO-2004059142 | 7/2004 |
| WO | WO-2007025375 | 3/2007 |

* cited by examiner

*Primary Examiner* — Edward Look
*Assistant Examiner* — Jason Davis
(74) *Attorney, Agent, or Firm* — Norman B. Thot

(57) ABSTRACT

A variable coolant pump for a cooling circuit of an internal combustion engine. The variable coolant pump includes a pump head having an inlet, an annular channel and an outlet; a pump housing rotatably supporting a pump shaft having an axial end; a pump blade wheel mounted on the axial end of the pump shaft and disposed in the pump head; and a plurality of adjustable guide blades arranged concentrically about the pump blade wheel between the annular channel and the pump blade wheel. Each adjustable guide blade has two longitudinal sides and outer edge and includes a first pivot, a second pivot and a third pivot. The first and second pivots extend at right angles to a respective one of the two longitudinal sides in a vicinity of the outer edge. The first and second pivots define an axis of rotation and rotatably support the respective guide-blade in the pump head about the axis of rotation. The third pivot is disposed in parallel with the first and second pivots in an area in the adjustable guide blade remote from the axis of rotation and protrude into an oblong recess in an adjustment ring rotatably arranged in the pump head. The oblong recess has a radial and a tangential component.

9 Claims, 3 Drawing Sheets

VARIABLE COOLANT PUMP FOR THE COOLING CIRCUIT OF AN INTERNAL COMBUSTION ENGINE

CROSS REFERENCE TO PRIOR APPLICATIONS

Priority is claimed to German Patent Application No. DE 10 2008 027 157.8, filed Jun. 6, 2008. The entire disclosure of said application is incorporated by reference herein.

FIELD

The present invention is directed to a variable coolant pump for the cooling circuit of an internal combustion engine, comprising a pump housing in which a mechanically or electrically driven pump shaft is rotatably supported and on whose axial end a pump blade wheel is mounted that is arranged in a pump head having an inlet, an annular channel and an outlet, a plurality of adjustable guide blades being arranged concentrically about the blade wheel between the annular channel and the blade wheel in the pump head.

BACKGROUND

To save fuel and to reduce the carbon dioxide emissions of an internal combustion engine, various measures have been proposed over the last years to provide a coolant conveyance in the coolant circuit of an internal combustion engine that is adapted to actual needs. In this context, one has to differentiate between electrically driven pumps where the coolant flow is changed by adjusting the rotational speed of the electric motor, and mechanically driven pumps, operated via a belt or chain drive, where the coolant flow is varied either via hysteresis clutches or changes in the inflow or outflow geometries in the area of the pump blade wheel. Compared to electric pumps or pumps with a hysteresis clutch, a control through a change in the inflow or outflow geometry is often clearly more economically realized.

Variable coolant pumps have thus been recently developed where the outlet cross section can be closed by means of a substantially pot-shaped valve element that is arranged for axial displacement in the pump housing. Mostly, the pot-shaped valve element is displaced using a solenoid acting on the pot-shaped valve element against a spring force so that, when the magnet is energized, the outlet cross section of the pump blade wheel is closed. Such coolant pumps are described, for example, in DE 10 2005 004 315 A1 or DE 10 2004 054 637 A1.

Drawbacks of these prior art embodiments are the rather high control effort of the solenoid and the rather large space required for accommodating a solenoid of enough strength to displace and support the pot-shaped valve element.

Coolant pumps are described in WO 2004/059142 A1 and WO 2007/025375 A2, wherein guide blades are arranged at the inlet in front of the blade wheel of the pump in order to control the incident flow to the blade wheel and thus the volume of coolant conveyed. To this end, the guide blades are swiveled approximately around their central axes via a turnable ring. These prior art embodiments are disadvantageous in that either the incident flow to the pump head has to be radial because the pump is driven on the suction side, or additional axial installation space is required for the accommodation of the guide blades. When the installation space is limited, the actuator has to apply a rather high torque in order to adjust the guide blades.

A centrifugal pump with adjustable guide vanes is described in DE 736 266, which are arranged in the vicinity of the pump's diffuser behind the blade wheel. These guide blades are also turned approximately about their central axes in order to avoid the occurrence of wobbling. Again, great actuating forces and high torques have to be applied by the actuator.

SUMMARY

An aspect of the present invention to provide a variable coolant pump that requires as little installation space as possible, and wherein the actuator required for the adjustment of the guide blades can be realized as small as possible.

In an embodiment, the present invention provides for a variable coolant pump for a cooling circuit of an internal combustion engine. The variable coolant pump includes a pump head having an inlet, an annular channel and an outlet; a pump housing rotatably supporting a pump shaft having an axial end; a pump blade wheel mounted on the axial end of the pump shaft and disposed in the pump head; and a plurality of adjustable guide blades arranged concentrically about the pump blade wheel between the annular channel and the pump blade wheel. Each adjustable guide blade has two longitudinal sides and outer edge and includes a first pivot, a second pivot and a third pivot. The first and second pivots extend at right angles to a respective one of the two longitudinal sides in a vicinity of the outer edge. The first and second pivots define an axis of rotation and rotatably support the respective guide-blade in the pump head about the axis of rotation. The third pivot is disposed in parallel with the first and second pivots in an area in the adjustable guide blade remote from the axis of rotation and protrude into an oblong recess in an adjustment ring rotatably arranged in the pump head. The oblong recess has a radial and a tangential component. Such an arrangement of the pivots and such a design of the oblong recesses in the adjustment ring allow a significant reduction of the torque to be applied by the actuator for a rotation of the adjustment ring as compared with known embodiments. In addition, the installation space required for the accommodation of the guide blades is reduced to a minimum, since the guide blades can be mounted in the vicinity of the pump head's diffuser.

BRIEF DESCRIPTION OF THE DRAWINGS

The present invention is described in greater detail below on the basis of embodiments and of the drawings in which.

DETAILED DESCRIPTION

Figure 1:
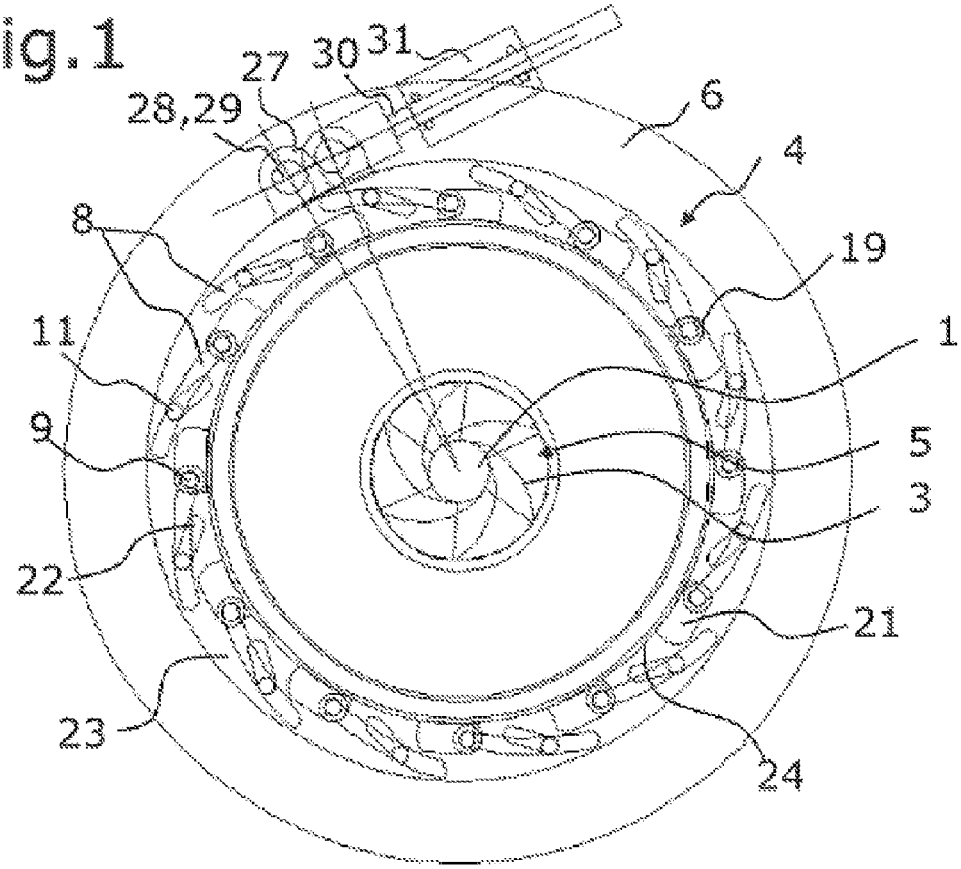
FIG. 1 is a schematic top plan view of a coolant pump of the present invention with the lid opened.

For a further reduction of the torque to be applied, the radial component is smaller over the entire adjustment angle than the tangential component.

The groove or the oblong hole is, for example, contoured so that the proportion of the radial component as compared to the tangential component increases as the adjustment angle increases from the closed guide blade position. Such a design of the grooves or oblong holes allows for a more precise control of the coolant volume conveyed, since a rotation of the adjustment ring from the closed position causes a lesser turning of the guide blades in a first region than in the following region. When the angle of rotation of the guide blades is the same, however, the difference in the coolant volume conveyed is larger than in the second portion. A precise control of the coolant volume thereby becomes possible, especially when little coolant is conveyed.

At the inner circumference of the adjustment ring, tangentially extending recesses can be formed for the passage of the first pivots, the length of which corresponds to the maximum angle of rotation of the adjustment ring, the first pivots being supported in the pump head. Such a structure minimizes the number of elements to be used. At the same time, the recesses serve as abutments for defining the maximum angle of rotation so that no tension or pressure forces can be caused between the two axes of the guide blade by the adjustment.

For the centring and the support of the adjustment ring and for the extension of the durability of the pivots, spacer rings are provided on the first pivots at the level of the recesses of the adjustment ring, wherein the outer diameter of the spacer rings substantially correspond to the width of the recesses and are received by the recesses in the adjustment ring so that these spacer rings serve as abutments and as guides and supports for the adjustment ring and thereby define the angle of rotation.

In an embodiment of the present invention, the guide blades are made from sheet metal and have a length corresponding to the distance from one axis of rotation to the adjacent axis of rotation. Such a structure is economic to manufacture.

In an embodiment of the present invention, the guide blades are profiled and are longer than the distance from one axis of rotation to the adjacent axis of rotation so that the end of each guide blade, averted from the axis of rotation, abuts in the vicinity of the rotational axis of the adjacent guide blade. This structure is suited to increase the efficiency of the pump by optimizing the flow discharge. In addition, great tightness can be achieved in the closed state of the guide blades.

A coolant pump can thereby be provided that is adapted to be controlled mechanically, while requiring only little adjustment forces. At the same time, the effort in components and installation space is minimized.

The coolant pump of the present invention, shown in part in FIGS. 1 to 4, is formed by a pump housing (not illustrated in the Figures) in which a driven pump shaft 1 is rotatably supported. The pump shaft 1 may be driven either mechanically by the crankshaft via a V-belt or a chain drive so that the pump shaft 1 is driven at a fixed rotational speed ratio with respect to the crankshaft, or the shaft may be driven at a constant rotational speed by means of an electric motor.

On one axial end 2 of the pump shaft 1, a pump blade wheel 3 is arranged that rotates together with the pump shaft 1. The pump blade wheel 3 is surrounded by a pump head 4 that is formed with a central inlet 5, an annular channel 6 as well as a tangential outlet, the outlet not being illustrated in the schematic illustration in the Figures.

Accordingly, when the pump blade wheel 3 rotates, the coolant is drawn through the axial inlet 5 into the pump blade wheel 3 and, at the radial outlet of the pump blade wheel, it is conveyed towards the annular channel 6, from where it flows to the tangential outlet of the pump head 4.

Figure 5:
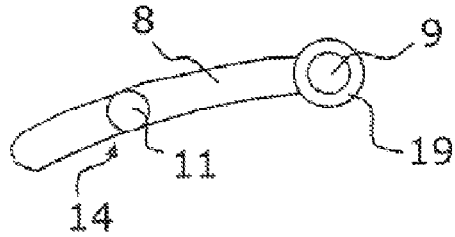
FIG. 5 is a side elevational view of a guide blade for a coolant pump according to the present invention.
Figure 6:
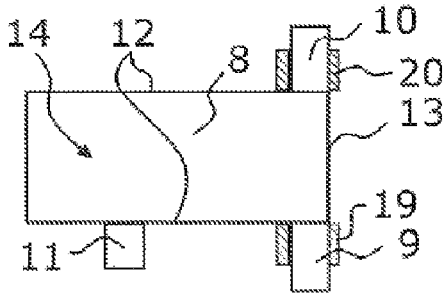
FIG. 6 is a top plan view on a guide blade as shown in FIG. 5.
Figure 7:
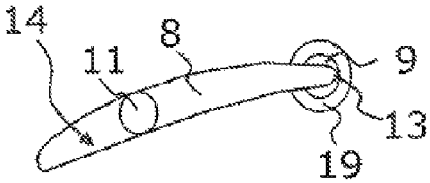
FIG. 7 is a side elevational view of a guide blade shown as an alternative embodiment to the one in FIG. 5.

Between the radial outlet of the pump blade wheel 3 and the annular channel 6, the pump head 4 is formed with a diffuser 7 in which, according to the present invention, guide blades 8 are arranged along a circular line. The guide blades 8 comprise three pivots 9, 10, 11, as shown in FIGS. 5 to 7. The pivots 9, 10, 11 can be perpendicular to the longitudinal axis 12 of each guide blade 8. The first and the second pivots 9, 10 can be arranged near an outer edge 13 of each guide blade 8. The pivot pins 9 and 10 serve as the axis of rotation of the guide blades 8. The third pivot 11 can be arranged in the area 14 of the guide blades 8 remote from the axis of rotation and can be slightly shorter than the first and second pivots 9, 10.

Figure 2:
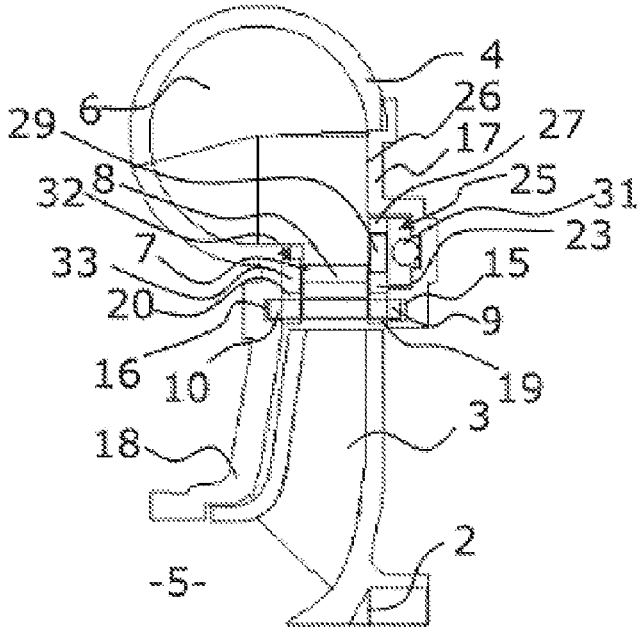
FIG. 2 is a side elevational view of the top half of the coolant pump illustrated in FIG. 1, shown in schematic section.
Figure 4:
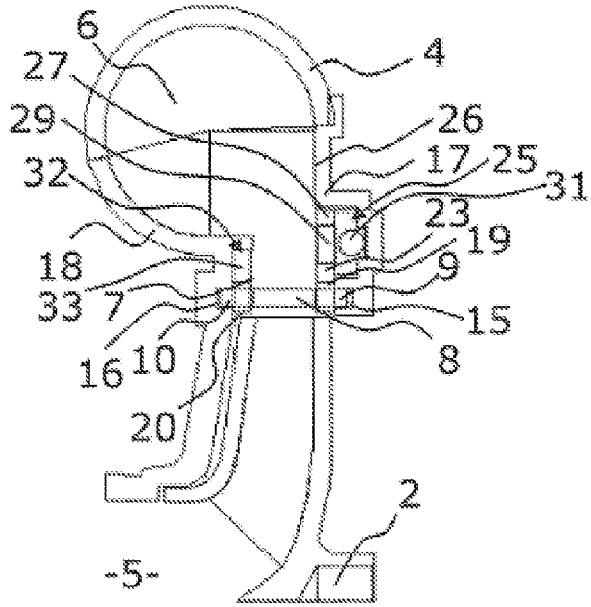
FIG. 4 is a side elevational view of the top half of the coolant pump illustrated in FIG. 3, shown in schematic section.

As shown in FIGS. 2 and 4, the first and second pivots 9, 10 can be supported in the pump head 4 of the coolant pump. For this purpose, the bipartite pump head 4 can be provided with two blind bores 15, 16 of which the first blind bore 15 can be formed in a rear wall 17 of the pump head 4, whereas the second blind bore 16 can be formed in a lid 18 of the pump head 4. In the assembled state of the pump head 4, the ends of the first and second pivots 9, 10, protruding beyond the third pivot 11, can be arranged in the blind bores 15, 16.

In the area adjacent to the guide blades 8, the first and second pivots 9, 10 can each be surrounded by spacer rings 19, 20 whose height is about equal to the height of the third pivot 11. According to the present invention, the spacer rings 19 and thus the first pivots 9 and the third pivots 11 cooperate with corresponding recesses 21 and grooves or oblong holes 22 of an adjustment ring 23 that is rotatably arranged in a space 25 of the rear wall 17 of the pump head 4 such that an inner wall 26 of the rear wall 17, leading to the annular channel 6, can be substantially linearly extended. The number of oblong holes 22 and recesses 21 corresponds to the number of guide blades 8. In the lid 18 of the pump head 4, a corresponding recess 32 can be formed in which another ring 33 can be arranged that, in the present embodiment, can be stationary in the housing and also can have recesses for receiving the second pivot 10.

The recesses 21 of the adjustment ring 23 extend tangentially on the inner circumference 24 of the adjustment ring 23 and have a tangential length corresponding to a maximum adjustment angle $\alpha$ of the adjustment ring 23. In these recesses 21, the first pivots 9 can be arranged together with their spacer rings 19. Seen in the circumferential direction of the adjustment ring 23, the oblong holes 22 can each be provided between the recesses 21 and have a width corresponding to the diameter of the third pivots 11. In the assembled state, the third pivots 11 each protrude into the oblong holes 22 that are inclined, i.e. have a radial component r and a tangential component t. The tangential component t can be larger over the whole adjustment angle $\alpha$ than the radial component r, wherein, in the present embodiment, the oblong holes 22 can be of linear shape.

The outer circumference of the adjustment ring 23 can be formed with a flange-shaped projection 27 having a through-hole 28 through which a pin 29 extends which is provided at the end of a lifting rod 30 of an actuator 31. In an embodiment, this actuator 31 is only schematically illustrated. It may be operated pneumatically, hydraulically, electrically or even magnetically. Generally, the lifting rod 30 is controlled in dependence on the thermal data of the internal combustion engine. The actuator 31 can, for example, also be arranged in the space 25 in the rear wall 17 of the pump head 4. Because of the special arrangement of the oblong holes 22 as well as the axis of rotation of the guide blades 8 with respect to the oblong holes 22, only low actuating forces occur so that the actuator 31 can be made compact in size.

It should be noted that the adjustment ring 23 should be supported in the pump head 4 in a manner that allows for an adjustment with as little friction as possible. Of course, it would be possible to also design the adjustment ring 23 as an adjustment ring with corresponding oblong holes into which fourth pivots would extend that would have to be arranged opposite the third pivots 11, whereby a guiding would be achieved on both sides, wherein a corresponding support would have to be provided for this ring as well and a coupling with the actuator 31 would be necessary.

Figure 3:
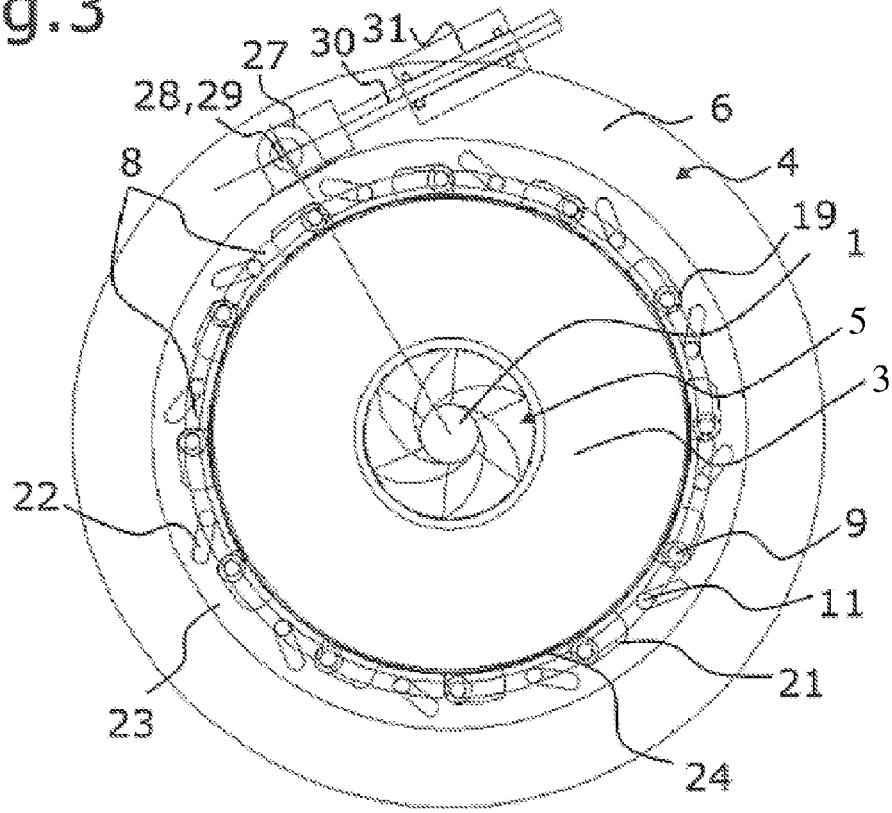
FIG. 3 is a view of the coolant pump, corresponding to FIG. 1, however, with the guide blades in a closed position.

In the event of a cold start of the internal combustion engine, the lifting rod 30 of the actuator 31 is in its extended position, as shown in FIGS. 3 and 4. Here, the adjustment ring 23 is rotated counter-clockwise by the lifting arm 30, whereby the third pivots 11 in the oblong holes 22 and the first pivots 9 in the recesses 21 abut against the first abutment on the adjustment ring 23. Since the beginning of the oblong holes 22 is spaced by the same radial distance from the centre of rotation of the adjustment ring as the oblong holes 15, 16, the guide blades 8, in this state, lie on a common circular line for their entire length. The length of the guide blades 8 is chosen such that the respective ends of the guide blades contact each other in this state so that the ring formed by the guide blades 8 is perfectly closed. This means that no coolant is conveyed in this state.

After the cold start phase has ended and the coolant has been heated up in the area of the cylinders, the actuator 31 is operated so that the lifting rod 30 is retracted at least in part, whereby the adjustment ring 23 rotates clockwise. This rotation causes the third pivots 11 to slide radially outward in the oblong holes 22, whereby the guide blades 8 are also rotated clockwise about their pivot axis. Thus, the coolant can now be conveyed by the pump blade wheel 3 into the annular channel 6 and thus toward the outlet. Here, the guide blades 8 assume a position by which the conveyance of the coolant in the coolant pump is further improved, since they serve as an outlet guide blade means. Depending on the position of the guide blades 8, respectively different coolant volumes can be conveyed at the same rotational speed of the pump so that a control is achieved that is effective over the entire range. The maximum discharge volume can be obtained in the fully open position of the guide blades 8 shown in FIGS. 1 and 2, in which the first pivots 9 and the second pivots 11 abut on the opposite abutments of the oblong holes 22 and the recesses 21, respectively.

The guide blades 8 shown in FIGS. 5 and 7 have different shapes, with the guide blade 8 shown in FIG. 5 being made, for example, of sheet metal and having a constant thickness, whereas the guide blade 8 shown in FIG. 7 is usually made, for example, from plastics and has a contoured shape especially suited for a further minimization of the pressure loss in the flow, while the sheet metal blade is extremely economic to manufacture.

Figure 8:
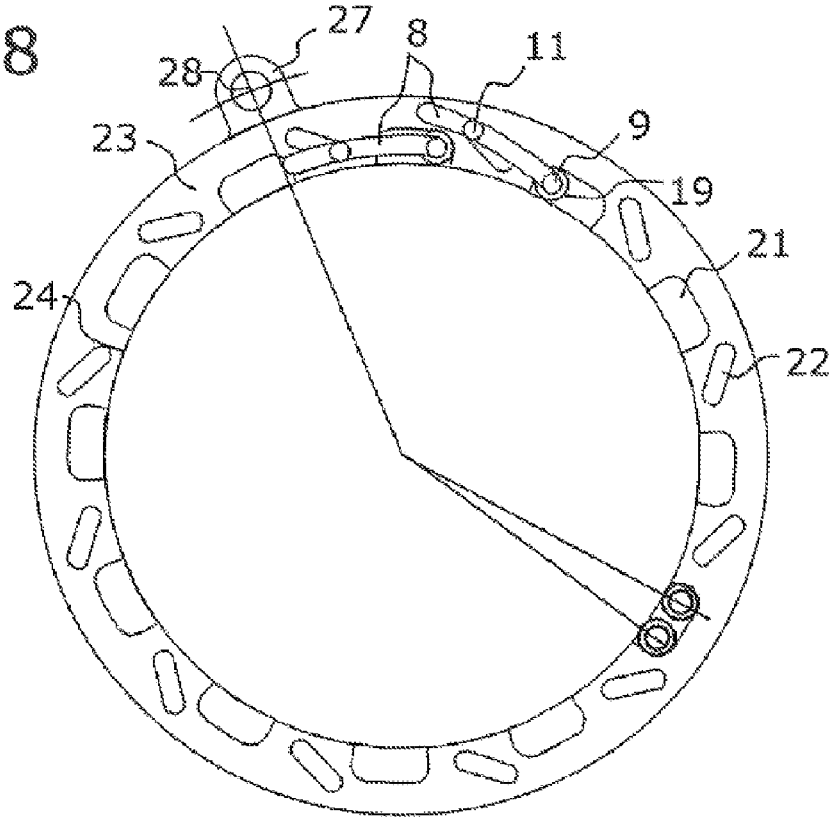
FIG. 8 is a top plan view on an adjustment ring according to the present invention, wherein one guide blade is illustrated in a closed position and another is shown in an opened position.

FIG. 8 shows the present adjustment ring 23 with two guide blades 8, of which a first one is in the open position, whereas a second one is in the closed position. In addition, the position of the spacer ring 19 of a guide blade 8 is illustrated in both end positions so that the maximum angle of rotation is visible. Compared to the embodiment shown in FIGS. 1 and 3, the guide blades 8 are longer in the present embodiment so that, in the closed position, the respective end of a guide blade 8 rests on the next guide blade 8 in the vicinity of the axis of rotation thereof. This additionally improves the tightness, however, with such a design, care should be taken that the shape of the guide blades is selected such that unwanted flow resistances and turbulences are avoided.

The coolant pump of the present invention is suited for a continuous regulation of the coolant volume in an internal combustion engine without having to use controlled shaft drives. The installation space required is extremely small. The actuation forces or the torque to be applied for adjusting the guide blades are extremely low because of the inclined arrangement of the oblong holes so that a smaller actuator can be used than in known embodiments.

An additional advantage is also obtained by a corresponding contouring of the oblong holes 22, while omitting the linearity, whereby, by the maximum possible adjustment angle, an adjustment angle of the guide blades 8, can be set that differs from the respective adjustment angle of the adjustment ring 23. Further modifications and structural changes can of course be made so that the scope of protection is not restricted to the embodiments described herein. For example, a second adjustment ring can also be provided on the opposite side of the pump head 4, cooperating with a corresponding fourth pin. Further, on this side, the support can be done immediately in the housing without interposition of another ring.

Although the present invention has been described and illustrated with reference to specific embodiments thereof, it is not intended that the present invention be limited to those illustrative embodiments. Those skilled in that art will recognize that variations and modifications can be made without departing from the true scope of the present invention as defined by the claims that follow. It is therefore intended to include within the present invention all such variations and modifications as fall within the scope of the appended claims and equivalents thereof.

What is claimed is:

1. A variable coolant pump for a cooling circuit of an internal combustion engine, the variable coolant pump comprising:

a pump head having an inlet, an annular channel and an outlet;

a pump housing rotatably supporting a pump shaft having an axial end;

a pump blade wheel mounted on the axial end of the pump shaft and disposed in the pump head; and a plurality of adjustable guide blades arranged concentrically about the pump blade wheel between the annular channel and the pump blade wheel, wherein:

each adjustable guide blade having two longitudinal sides and an outer edge, the outer edge being disposed at an end of the two longitudinal sides, and including a first pivot, a second pivot and a third pivot, wherein the first and second pivots extend at right angles to a respective one of the two longitudinal sides in a vicinity of the outer edge, the first and second pivots define an axis of rotation and rotatably support the respective guide blade in the pump head about the axis of rotation, wherein the third pivot is disposed in parallel with the first and second pivots in an area in the adjustable guide blade remote from the axis of rotation and protrudes into an oblong recess in an adjustment ring rotatably arranged in the pump head, and wherein the oblong recess has a radial and a tangential component.

2. The variable coolant pump as recited in claim 1, wherein the oblong recess includes one of an oblong hole and a groove.

3. The variable coolant pump as recited in claim 1, wherein the pump is at least one of a mechanically and an electrically driven pump.

4. The variable coolant pump as recited in claim 1, wherein the radial component is smaller over an entire adjustment angle of the adjustment ring than the tangential component.

5. The variable coolant pump recited in claim 1, wherein the oblong recess is contoured to increase a proportion of the radial component as compared to the tangential component as an adjustment angle of the adjustment ring increases from a closed position of the adjustable guide blades.

6. The variable coolant pump as recited in claim 1, wherein an inner circumference of the adjustment ring includes tangentially extending recesses for receiving the first pivots, each recess having a length corresponding to a maximum angle of rotation of the adjustment ring.

7. The variable coolant pump as recited in claim 1, further comprising a plurality of spacer rings each disposed on a respective one of the first pivots, wherein the adjustment ring includes a plurality of recesses disposed at a level of the spacer rings, an outer diameter of each spacer ring substantially corresponding to a width of a respective one of the recesses and serving as support for the adjustment ring.

8. The variable coolant pump as recited in claim 1, wherein the plurality of adjustable guide blades are made from sheet metal and each has a length corresponding to a distance from the axis of rotation of the respective adjustable guide blade to the axis of rotation of an adjacent adjustable guide blade.

9. The variable coolant pump as recited in claim 1, wherein each adjustable guide blade is profiled and is longer than the distance from the axis of rotation of the adjustable guide blade to the axis of rotation of an adjacent adjustable guide blade so that an end of each adjustable guide blade, averted from the axis of rotation, abuts in a vicinity of the rotational axis of the adjacent adjustable guide blade.

* * * * *